United States Patent [19]

Costin

[11] 4,014,692

[45] Mar. 29, 1977

[54] PLATINUM-RHODIUM ALLOYS HAVING LOW CREEP RATES

[75] Inventor: Darryl J. Costin, Columbus, Ohio

[73] Assignee: Owens-Corning Fiberglas Corporation, Toledo, Ohio

[22] Filed: Jan. 9, 1976

[21] Appl. No.: 647,690

[52] U.S. Cl. ..... 75/172 R; 65/12

[51] Int. Cl.[2] ..... C22C 5/04

[58] Field of Search ..... 75/172 R; 65/12

[56] References Cited

UNITED STATES PATENTS 3,622,310 11/1971 Reinacher et al. ..... 75/172 R X

FOREIGN PATENTS OR APPLICATIONS 1,238,013 7/1971 United Kingdom ..... 75/172 R

*Primary Examiner*—C. Lovell
*Assistant Examiner*—E. L. Weise
*Attorney, Agent, or Firm*—John W. Overman; Philip R. Cloutier

[57] ABSTRACT

Platinum-rhodium alloys containing small amounts of boron and zirconium have low creep rates and high resistance to glass corrosion making the alloys particularly suitable for glass-fiberizing bushings.

9 Claims, 2 Drawing Figures

PLATINUM-RHODIUM ALLOYS HAVING LOW CREEP RATES

Figure 1:
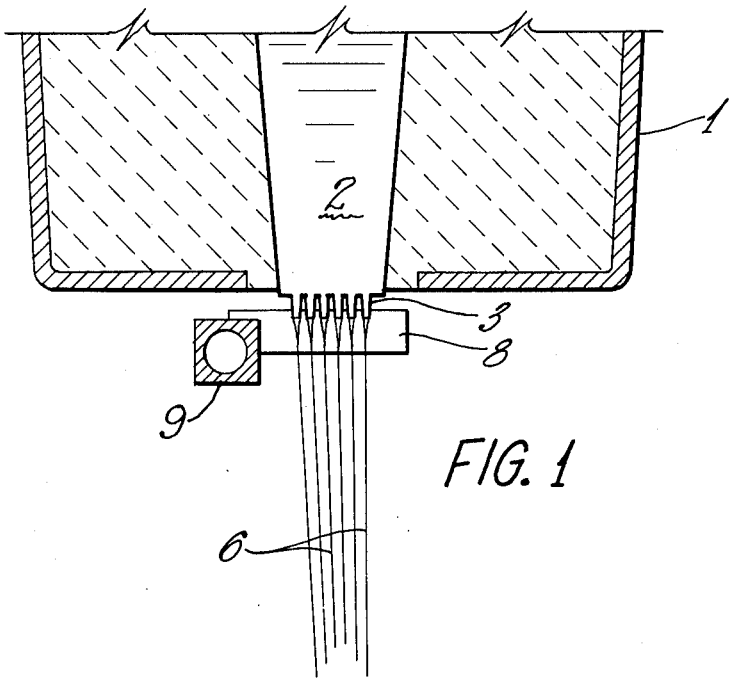

This invention relates to platinum-rhodium alloys having low creep rates.

In one of its more specific aspects, this invention relates to alloys particularly suitable for the production of bushings employed for the production of glass fibers.

In a present method of producing glass fibers, molten glass is drawn through one or more orifices positioned in one wall of a chamber called a bushing. The bushing must be chemically resistant to the molten glass and must be dimensionally stable at operating temperatures in the range of from about 1800° F to about 2500° F.

Dimensional stability, particularly in respect to creep rate, is of particular significance inasmuch as deformation of the bushing results in improper heat distribution across the orifice-containing wall of the tip section of the bushing, misalignment of the orifices and enlargement of the orifices through which the molten glass is withdrawn.

There is a wide variety of bushings known in the art. For example, two such assemblies are shown in U.S. Pat. Nos. 2,515,738 and 2,908,036.

Binary platinum-rhodium alloys have been most successfully used in continuous glass-fiberizing bushings because of the unique chemical inertness of such alloys to molten glass environments at elevated temperatures. However, recent developments in the technology of glass fiberizing are approaching the limits of strength that can be achieved in the platinum group metals by conventional solid solution strengthening. The intrinsic lack of elevated temperature creep and stress-rupture strength of the prior art platinum-rhodium alloys have imposed severe limitations on both the design of fiberizing bushings and the temperature of the fiberizing operations. In general, it has been found that ternary non-precious metal elemental additions to prior art alloys provide only marginal increases in mechanical properties and then only at the expense of a significant reduction in glass corrosion and oxidation-resistant properties.

There has now been developed an alloy which is produced by conventional alloying techniques and which has superior high temperature stress-rupture and creep properties while being equivalent to the best prior art alloy in respect to resistance to glass corrosion and oxidation. This alloy is particularly suitable for employment as fiberizing hardware such as bushings, the service life of which is limited by tip section sag or creep at elevated temperatures.

According to this invention there is provided, in one embodiment of this invention, a composition consisting essentially of rhodium in an amount within the range of from about 10 to about 40 weight percent, boron in an amount within the range of from about 0.01 to about 0.5 weight percent, zirconium in an amount within the range of from about 0.015 to about 1.25 weight percent, with the balance of the composition being platinum.

In one of its preferred embodiments, the composition will consist essentially of rhodium in an amount within the range of from about 22 to about 26 weight percent, boron in an amount within the range of from about 0.04 to about 0.09 weight percent, zirconium in an amount within the range of from about 0.075 to about 0.175 weight percent, with the balance of the composition being platinum.

In its preferred embodiment the composition will consist essentially of about 25 weight percent rhodium, about 0.05 weight percent boron, about 0.1 weight percent zirconium with the balance of the composition being platinum.

The alloy of this invention consists in its most preferred embodiments, of a platinum-rhodium solid solution matrix in which small quantities of boron and zirconium, preferably, are dispersed therein.

In a less preferred embodiment of this invention, at least one element selected from the group consisting of hafnium and magnesium can be substituted for all or part of the zirconium. It is to be understood that an alloy employing hafnium and/or magnesium is not the equivalent of one employing solely zirconium.

In a less preferred embodiment of this invention, at least one element selected from the group consisting of yttrium, lanthanum, titanium, niobium, and tantalum can be substituted for all or part of the zirconium. It is to be understood that an alloy produced by such a substitution is not the equivalent to one employing solely zirconium.

When so substituted the substituted element or elements, are included in a total amount equal to that amount in which the zirconium would be included.

Also, according to this invention, there is provided a bushing comprising the alloy defined in the aforementioned embodiment of the composition.

The alloys of this invention are produced by standard melting and casting techniques. Preferably, the alloy will be hot forged and annealed in order to obtain the stock required for the production of the bushing.

Figure 2:
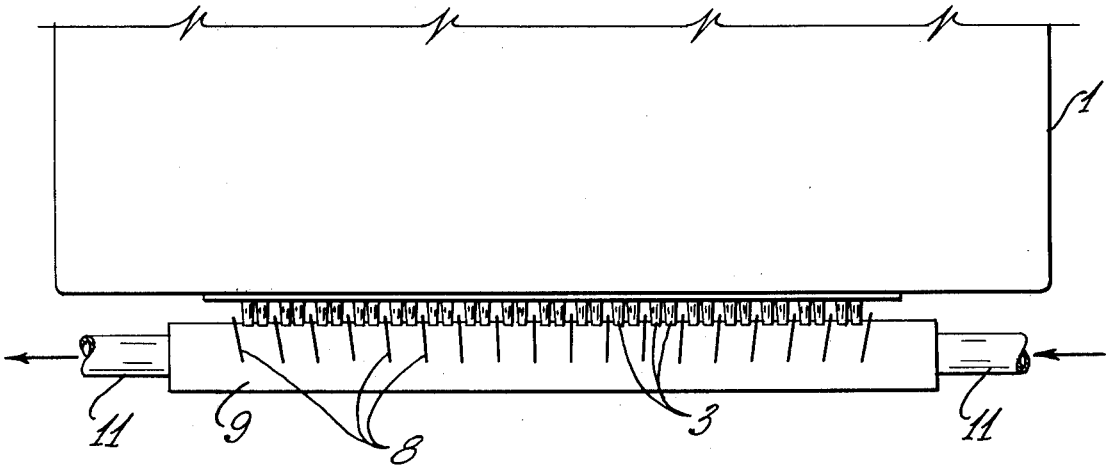

The alloys of this invention are particularly suitable for the production of bushings, a typical bushing being illustrated in attached FIGS. 1 and 2. FIG. 1 is side-elevational view of a fiber-forming bushing and FIG. 2 is a partial front-elevation view of the apparatus of FIG. 1.

Referring now to these figures, there is shown bushing 1 comprising a chamber for holding glass mass 2. The chamber is adapted with feeder tips 3 through which glass is emitted and attenuated into fibers 6. Positioned between feeder tips 3 can be fins, or finshields, 8 extending from a cooled manifold 9, a coolant being supplied through conduit 11. Any, or all, portions of such a bushing can be produced of the alloy described herein. Preferably, the chamber and feeder tips will be fabricated of the alloy of this invention.

An alloy of this invention consisting essentially of about 25 weight percent rhodium, 0.05 weight percent boron and 0.1 weight percent zirconium was produced by melting platinum and rhodium together under a pressure of about 10 microns of mercury. The boron and zirconium were introduced into the melt just before pouring. The resulting ingot was then hot forged at 2050° F with two intermediate anneals for 20 minutes at 2050° F until sheet stock having a thickness of about 0.045 inches was obtained. Creep, stress-rupture, oxidation and glass corrosion specimens were machined from the sheet stock and the following resuts were obtained:

| Stress, (psi) | Temperature, (° F) | Rupture Life, Hrs. | Creep Rate In/In/Hr. × $10^{-4}$ |
|---|---|---|---|
| 4000 | 1800 | 485 | 4.09 |
| 3000 | 2000 | 115 | 5.58 |
| 2000 | 2200 | 177 | 6.53 |
| 1000 | 2400 | 406 | 3.55 |

Corrosion values were comparable to those of prior art alloys.

It is seen from the above that the alloy of this invention provides excellent creep and stress rupture properties without sacrificing glass corrosion or oxidation resistance.

It will be evident that various modifications can be made to this invention. Such, however, are considered as being within the scope of the invention.

What is claimed is:

1. A composition consisting essentially of rhodium in an amount within the range of from about 10 to about 40 weight percent, boron in an amount within the range of from about 0.01 to about 0.5 weight percent, zirconium in an amount within the range of from about 0.015 to about 1.25 weight percent, the balance of said composition being platinum.

2. The composition of claim 1 in which rhodium is present in an amount within the range of from about 22 to about 26 weight percent, boron is present in an amount within the range of from about 0.04 to about 0.09 weight percent, and zirconium is present in an amount within the range of from about 0.075 to about 0.175 weight percent.

3. The composition of claim 1 in which rhodium is present in an amount of about 25 weight percent, boron is present in an amount of about 0.05 weight percent and zirconium is present in an amount of about 0.1 weight percent.

4. A composition consisting essentially of rhodium in an amount within the range of from about 10 to about 40 weight percent, boron in an amount within the range of from about 0.01 to about 0.5 weight percent and zirconium, hafnium and magnesium in a total amount within the range of from about 0.015 to about 1.25 weight percent, the balance of said composition being platinum.

5. A composition consisting essentially of rhodium in an amount within the range of from about 10 to about 40 weight percent, boron in an amount within the range of from about 0.01 to about 0.5 weight percent and zirconium and hafnium in a total amount within the range of from about 0.015 to about 1.25 weight percent, the balance of said composition being platinum.

6. A composition consisting essentially of rhodium in an amount within the range of from about 10 to about 40 weight percent, boron in an amount within the range of from about 0.01 to about 0.5 weight percent and zirconium and magnesium in a total amount within the range of from about 0.015 to about 1.25 weight percent, the balance of said composition being platinum.

7. A composition consisting essentially of rhodium in an amount within the range of from about 10 to about 40 weight percent, boron in an amount within the range of from about 0.01 to about 0.5 weight percent hafnium and magnesium in a total amount within the range of from about 0.015 to about 1.25 weight percent, the balance of said composition being platinum.

8. A composition consisting essentially of rhodium in an amount within the range of from about 10 to about 40 weight percent, boron in an amount within the range of from about 0.01 to about 0.5 weight percent and at least one element selected from the group consisting of yttrium, lanthanium, titanium, niobium, and tantalum in a total amount within the range of from about 0.015 to about 1.25 weight percent, the balance of said composition being platinum.

9. A bushing comprising the composition of claim 1.

* * * * *